US006006050A

United States Patent [19]

Watanabe et al.

[11] Patent Number: 6,006,050

[45] Date of Patent: Dec. 21, 1999

[54] IMAGE FORMING METHOD AND APPARATUS FOR CONTROLLING AMOUNT OF SUPPLIED TONER OR AGITATING TIME

[75] Inventors: Shigeru Watanabe; Masaru Tanaka, both of Yokohama; Haruji Mizuishi, Tokyo; Toshitaka Yamaguchi, Ohmiya; Kenzou Tatsumi, Yokohama; Hiroshi Yoshinaga, Ichikawa; Takeo Suda; Ken Amemiya, both of Tokyo; Mayumi Oh-Hori, Kawasaki, all of Japan

[73] Assignee: Ricoh Company, Ltd., Tokyo, Japan

[21] Appl. No.: 08/961,515

[22] Filed: Oct. 30, 1997

[30] Foreign Application Priority Data

| | | | |
|---|---|---|---|
| Nov. 1, 1996 | [JP] | Japan | 8-292007 |
| Nov. 11, 1996 | [JP] | Japan | 8-314197 |
| Aug. 12, 1997 | [JP] | Japan | 9-231795 |

[51] Int. Cl.[6] ..... G03G 15/08

[52] U.S. Cl. ..... 399/58; 118/694; 399/59; 399/61

[58] Field of Search ..... 399/58, 59, 61–63; 118/694

[56] References Cited

U.S. PATENT DOCUMENTS

| | | | |
|---|---|---|---|
| 5,166,730 | 11/1992 | Urabe | 399/59 |
| 5,523,832 | 6/1996 | Hamamichi et al. | 399/59 X |
| 5,634,174 | 5/1997 | Mori et al. | 399/62 |
| 5,717,973 | 2/1998 | Endoh et al. | 399/63 |

*Primary Examiner*—William J. Royer
*Attorney, Agent, or Firm*—Cooper & Dunham LLP

[57] ABSTRACT

An image forming apparatus including an image bearing member, a latent image forming device which forms a latent image on the image bearing member, a developing device which develops the latent image using a two-component developer including a toner and a carrier and a toner supplying device which supplies toner into the developing device. A developer agitating device agitates developer in the developing device and a toner-density detecting device detects a toner density of developer in the developing device. A toner-density control device controls the toner density by operating the toner supplying device on the basis of a detected result according to the toner-density detecting device. A memory device stores resultant value of the toner density detected by the toner-density detecting device during image forming operations. The toner-density detecting device detects the toner density in a warm-up operation before starting the image forming operation by the image forming apparatus. The toner-density control device changes an amount of the toner supply which is supplied by the toner supplying device after starting the image forming operation according to a result of a comparison of the detected toner density in the warm-up operation with the detected result stored in the memory device. The toner-density control device changes an amount of the toner supply which is supplied by the toner supplying device after starting the image forming operation according to the resultant value of comparison of a result of a detection.

24 Claims, 12 Drawing Sheets

IMAGE FORMING METHOD AND APPARATUS FOR CONTROLLING AMOUNT OF SUPPLIED TONER OR AGITATING TIME

BACKGROUND OF THE INVENTION

1. Field of the Invention

This invention relates to an image forming apparatus such as a copying machine, facsimile machine, printer, and the like, and more particularly to an image forming apparatus having a function for controlling toner density.

2. Discussion of the Background

In developing methods using powder toner, particularly in a developing method using a one-component type developer including a toner as a main-component (hereinafter referred to as a one-component developing method), various methods for charging the toner have been proposed. For example, Japanese Laid-Open Patent Application No. 4-184462/1992 discloses a technique which improves the charging-property of toner by activating movement of the magnetizable toner by rotating a rod-shaped developer regulating member disposed adjacent to a developing sleeve which serves as a toner bearing member. However, in this technique, charging of the toner is mostly performed by the contact charging between the developer bearing member and the toner, and therefore uniform charge of the toner cannot be obtained.

In contrast, in a developing method using a two-component developer composed of a carrier and a toner (hereinafter referred to as a two-component developing method), toner can be more stably charged and fed when compared to the toner of the one-component developing method. Therefore, the two-component developing method is widely used for middle-copying-speed type and high-copying-speed type printers, copying machines and the like.

In the aforementioned two-component developing method, only the toner is consumed in the image developing process, and therefore a mixing ratio of the toner and the carrier varies. Therefore, it is necessary to maintain the mixing ratio of the toner and the carrier within a fixed range to stably obtain images having good image qualities. In other words, if the toner density (the weight ratio of the toner to the developer) changes, an amount of toner supplied to a developing area and an amount of charge of the toner changes, resulting in variations in image quality. More specifically, when the toner density is relatively low, the toner cannot be sufficiently supplied to the developing area. In addition, the amount of charge of the toner increases resulting in deterioration of the developing ability of the developer. On the other hand, if the toner density is relatively high, the toner is oversupplied to the developing area, or the toner tends to adhere to the image bearing member due to insufficient charging of the toner caused by a decrease in the probability of contact of the toner with the carrier. Accordingly, the toner undesirably adheres to a non-image part of the image bearing member, resulting in fouling of the background of an image (hereinbelow referred to as background fouling).

In order to control the toner density, a toner supply control method has been proposed in which a toner supplying device controls the toner supply based on data of a toner density in a developing unit detected by a toner-density detecting device using a permeability measuring sensor or the like. However, for example, in a low cost and light-duty copying machine, the copying machine is often left without being used for extended periods of time and, therefore, the developer tends to be left for long periods of time without being used. If the developer is left for a long period of time without being used, the charge to the carrier and the toner of the developer in the developing unit is naturally discharged resulting in a decrease of the amount of charge of the carrier and the toner. When an image forming operation is performed after leaving the apparatus unused for a long time, problems such as toner scattering and background fouling caused by the decrease of the charging amount of the toner tends to occur.

In addition, because of the decrease of the charging amount of the developer including the carrier and the toner, repulsion of the developer decreases or air enters the developer naturally, resulting in a decrease in the bulk of the developer. The aforementioned permeability sensor detects a distance between the carrier (which is magnetic) and the sensor. When the amount of toner decreases, the carrier is close to the sensor, and therefore the toner density is judged to be low by the sensor. In addition, however, when the carrier is close to the sensor because of a decrease in the bulk of the developer, the sensor erroneously detects that the toner density has decreased, although the toner density has not varied. Since the toner supplying device supplies toner on the basis of the data detected by the sensor, the toner density in the developing unit increases, resulting in occurrence of problems such as toner scattering and background fouling.

Such a problem occurs when the toner density is falsely detected with a toner density detecting devices and can occur not only in a permeability sensor type device, but also with other toner density detecting device having a construction which outputs false detected data from other than a permeability measuring sensor. For example, other toner density detecting devices detect the toner density by methods influenced by a decrease of the charge amount or the bulk of the developer which tend to occur when the image forming apparatus is left without being used for a long period of time.

SUMMARY OF THE INVENTION

In view of the above-mentioned considerations it is an object of the present invention to provide an image forming apparatus capable of preventing toner scattering or background fouling even when an image forming operation is performed after the apparatus is left for a long time without being used.

According to an aspect of the present invention an image forming apparatus includes an image bearing member and a latent image forming device which forms a latent image on the image bearing member.

A developing device which develops the latent image using a two-component developer including toner and carrier is provided with a toner supplying device which supplies toner into the developing device.

A developer agitating device agitates developer in the developing device.

A toner-density detecting device detects a toner density of developer in the developing device.

A toner-density control device controls the toner density by operating the toner supplying device on the basis of a detected result according to the toner-density detecting device.

A memory device stores resultant values of the toner density detected by the toner-density detecting device during the image forming operation.

The toner-density control device changes an amount of toner which is supplied by the toner supplying device after starting the image forming operation according to the resultant value of a comparison of a detected toner-density detected during a warming up operation and the resultant value of the toner density stored in the memory device.

The toner-density control device changes the amount of toner supplied by the toner supplying device until a predetermined time period has passed after starting the image forming operation according to the resultant value of the comparison of the toner density.

The toner-density control device determines the predetermined time period for changing the amount of the toner supply according to the resultant value of the comparison of the toner density.

The toner density is detected at a time of warming up, and the amount of the toner supply is corrected from the first toner supply after a previous stop of the image forming apparatus according to the resultant value of the comparison of the toner density.

The toner supplying operation is performed on the basis of the difference between the detected value of the toner density and a reference value of the toner density, and the reference value is changed according to the resultant value of the comparison of the detected value of the toner density at a time of a warming up operation and the detected value stored in the memory device.

The output value of the toner-density detecting device is detected at a time of a warming up operation, and an agitating time period of the developer is changed according to the resultant value of the comparison of the output value of the toner density and the output value of the toner-density detecting device at a time of a previous image forming operation.

The output value of the toner-density detecting device at a time of warming up of the image forming apparatus is detected, and the agitation of the developer is performed until the output value reaches a certain reference value, according to the resultant value of the comparison of the output value of the toner density and the output value at a time of a previous image forming operation.

BRIEF DESCRIPTION OF THE DRAWINGS

A more complete appreciation of the invention and the attendant advantages thereof will be readily obtained by referring to the following detailed description when considered in connection with the accompanying drawings, wherein.

DESCRIPTION OF THE PREFERRED EMBODIMENT

An embodiment of the present invention applied to an electrophotographic copying machine (hereinafter referred to as a copying machine) is hereinbelow explained.

Figure 1:
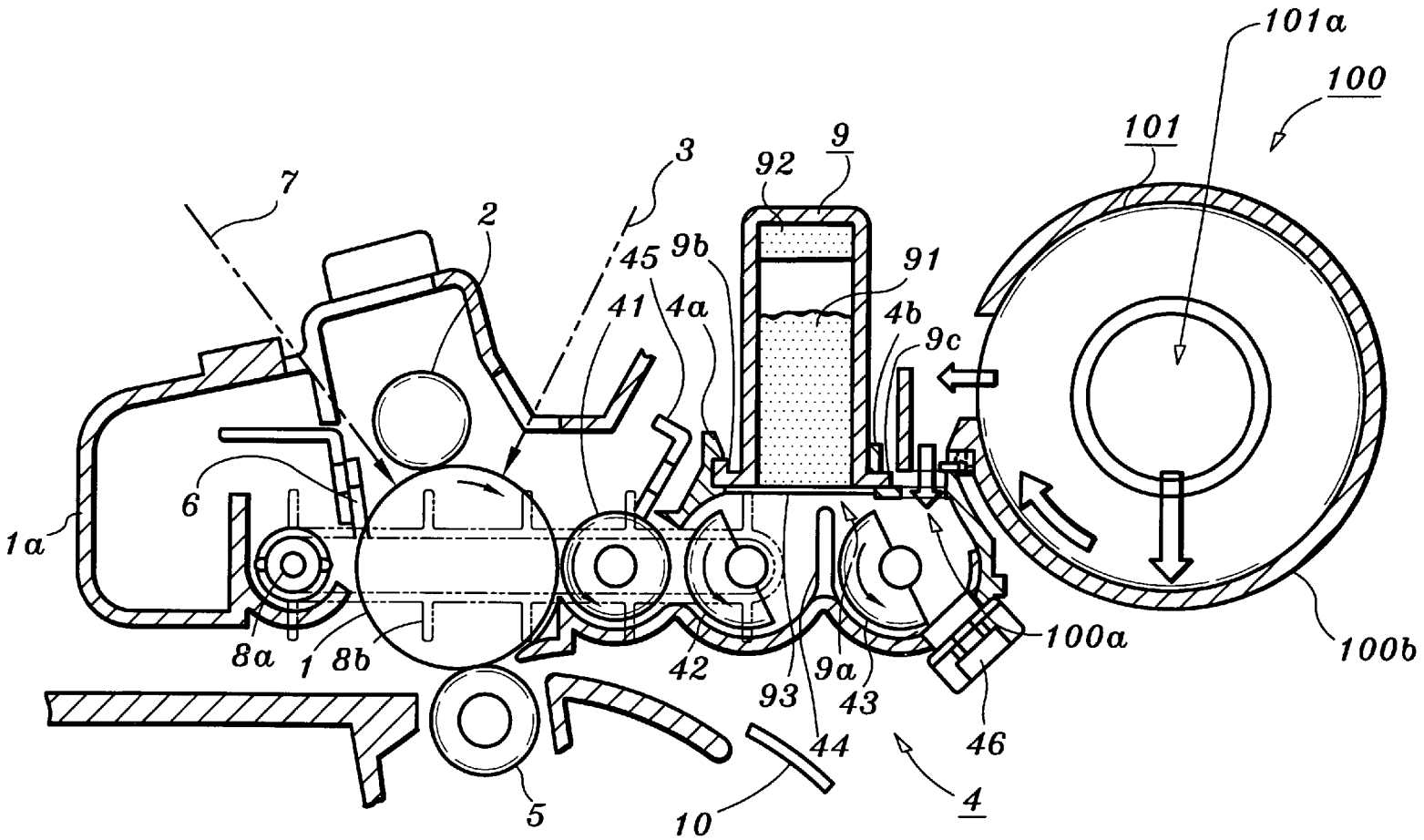
FIG. 1 is a schematic elevational view showing a construction of an electrophotographic copying machine of the present invention.

FIG. 1 shows a schematic of a fundamental construction of a copying machine according to the present invention. The schematic of the entire copying machine is first explained. In FIG. 1, a drum-shaped photoconductive element 1 (e.g., an image bearing member), is uniformly charged with a charging roller 2. Image information is then optically written on the photoconductive element 1 by irradiating image exposing light 3 whose intensity is modulated by the image information and which is irradiated with a writing device (not shown) (e.g., an image exposing device), so that a latent image of the image information is formed on the photoconductive element. The latent image is developed to form a toner image with toner on a developing sleeve 41 in which a developing bias is applied and which is mounted on a developing unit 4 disposed on a right side of the photoconductive element. The photoconductive element 1 on which the toner image is formed rotates, and the toner image is transferred onto a transfer sheet 10 conveyed from a sheet feeding section (not shown) at a transfer roller 5 so that a tip portion of the image forming position on the transfer sheet 10 faces a tip portion of the toner image on the photoconductive element 1 at the transfer roller 5. The transfer sheet 10 on which the toner image is transferred is separated from the photoconductive element 1 using a separation charger (not shown), and conveyed to a fixing section (not shown). The toner on the transfer sheet 10 is then melted and fixed thereon upon application of heat and pressure thereto at the fixing section, and discharged from the apparatus. On the other hand, the toner remaining on the photoconductive element 1 after the transfer of the toner image is scraped off with a cleaning blade 6 in a cleaning section, and thereby the remaining toner is removed from the photoconductive element 1. A charge remaining on the photoconductive element 1 is discharged with a discharging light 7 emitted from a discharging lamp (not shown) and a surface electric potential is averaged so as to be a standard electric potential so that the photoconductive element 1 is ready for the next charging with charging roller 2. The remaining toner scraped off from the photoconductive element 1 with the cleaning blade 6 falls down to a toner collecting container mounted on a part of a photoconductive element casing 1*a*. The collected toner is conveyed to an end of a longitudinal direction of a conveying screw 8*a* by rotation thereof, and then returned to the developing unit 4 with a recycle belt 8*b* to recycle toner. Further, a humidity sensor (not shown) for detecting humidity is mounted near a point just above the developing unit 4 in FIG. 1.

In the aforementioned developing unit 4, the developing sleeve 41 (e.g., a developer bearing member), conveys developer 91 to a facing position of the photoconductive element 1 and the developing sleeve 41 by rotating in a direction indicated by an arrow while bearing the two-component developer 91 composed of the carrier and the toner. First and second agitating rollers 42 and 43 are provided for agitating the developer 91 and are disposed parallel to the longitudinal direction of the photoconductive element 1. The first agitating roller 42 and the second agitating roller 43 are separated from each other by a partition plate 44. The first agitating roller 42 is located adjacent to the developing sleeve 41, and the second agitating roller 43 is located adjacent to a toner supplying opening 100*a* from which the toner is supplied with a toner supplying device 100. A plurality of paddles are mounted on the first agitating roller 42 and the second agitating roller 43 for agitating the developer 91 and conveying the developer 91, respectively. The paddles agitate and convey the developer 91 by rotating in a direction indicated by the arrows as shown in FIG. 1, by a driving device (not shown). The agitation and the conveyance of the developer 91 are explained later. The developer 91 is agitated and conveyed along the longitudinal direction of the agitating rollers 42 and 43, and is supplied to the developing sleeve 41 on which a developer layer having a predetermined thickness is formed with a doctor blade 45, and then supplied to the photoconductive element 1 from the developing sleeve 41.

Figure 2:
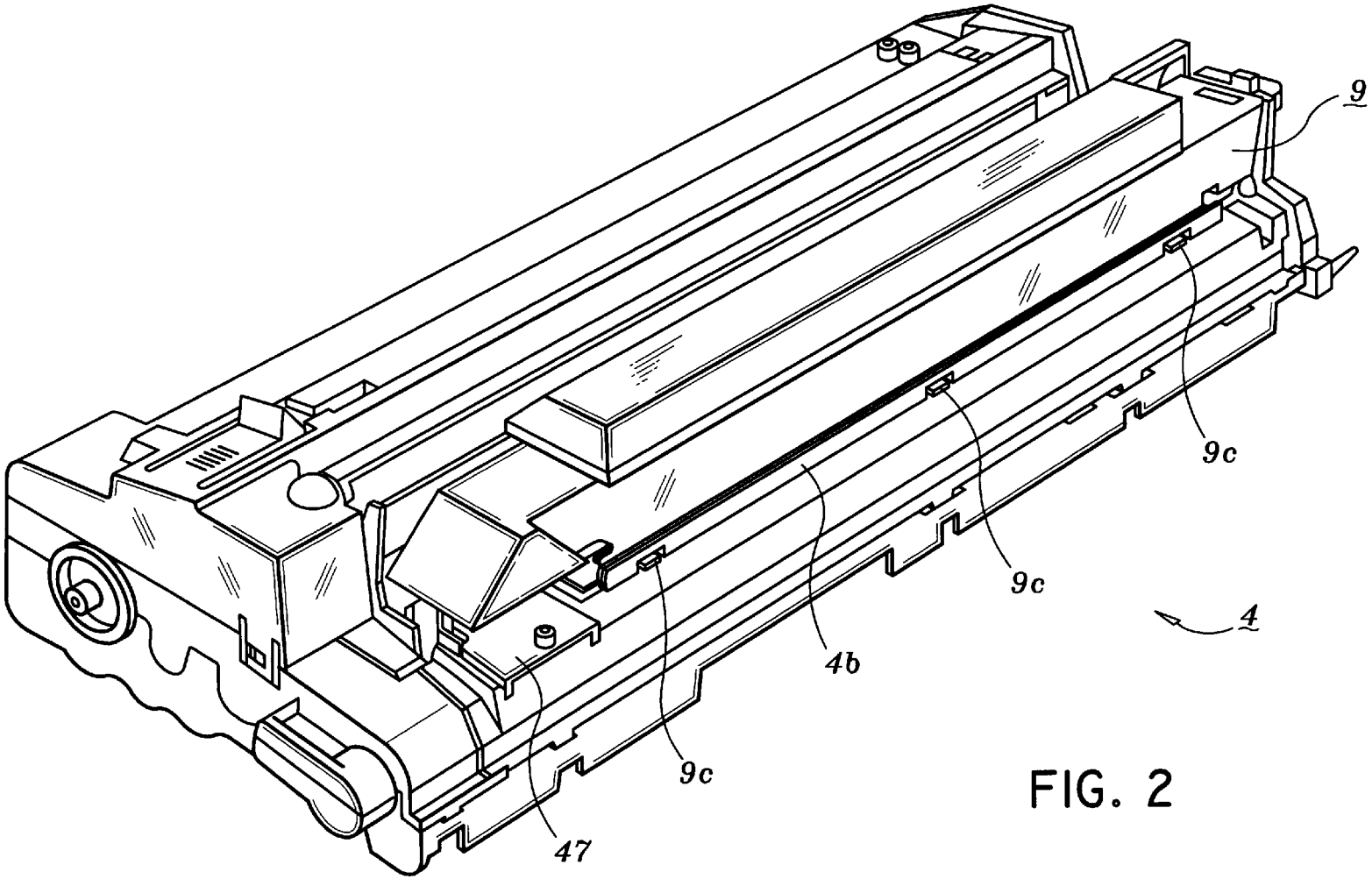
FIG. 2 is a perspective illustration showing an outer view of the developing unit of the copying machine illustrated in FIG. 1.
Figure 3:
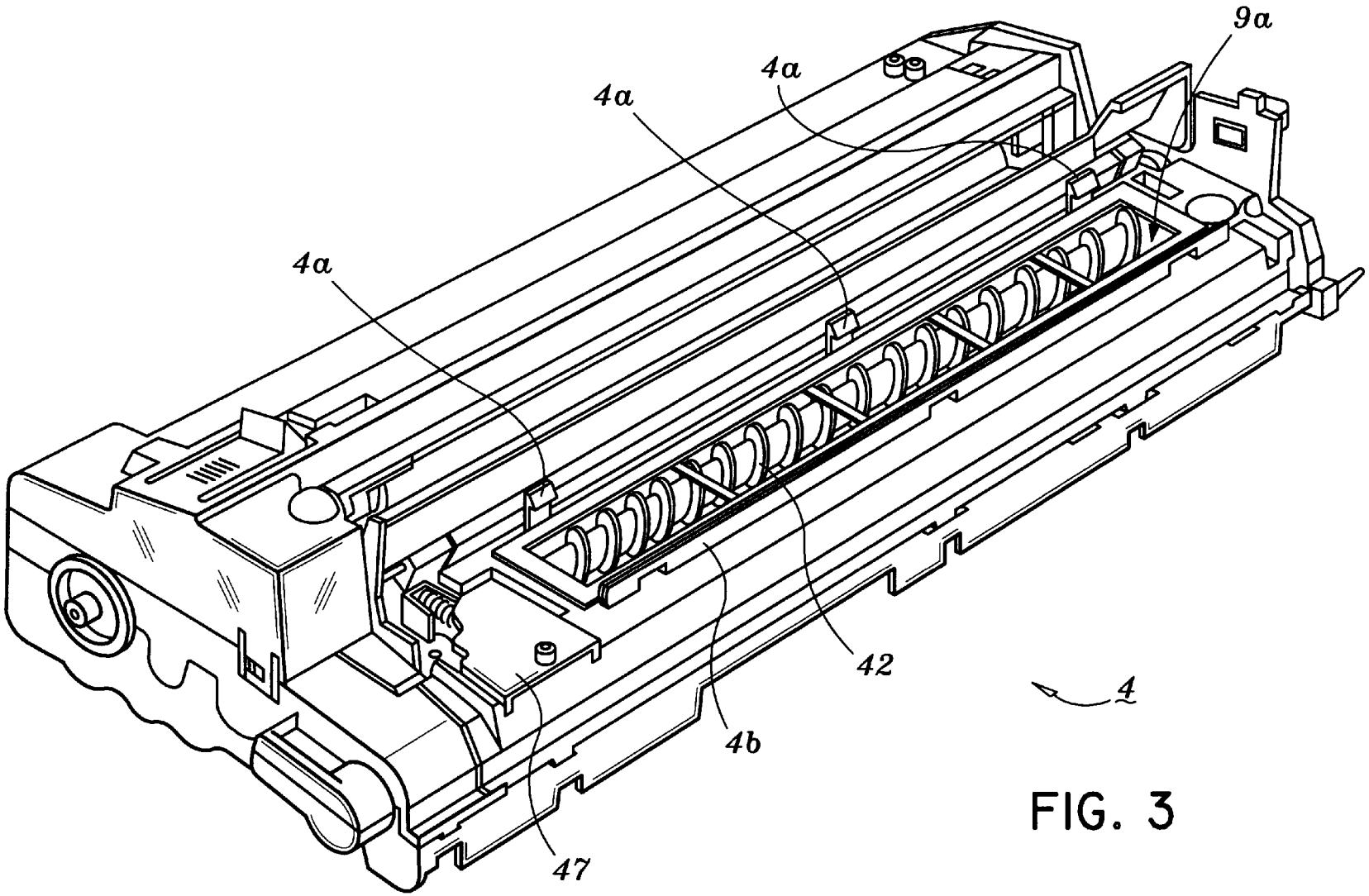
FIG. 3 is a perspective illustration showing the outer view of the developing unit shown in FIG. 2 from which a developer container is removed.

Next, a developer container 9 is explained using FIGS. 1–3. FIGS. 2 and 3 are perspective illustrations showing an outer view of the developing unit 4. A relatively long opening 9*a* is formed in a predetermined area in an upper wall of a casing of the developing unit 4 which extends over the first and second agitating rollers along the agitating rollers. A box-shaped developer container 9 is detachably mounted on the developing unit 4 at an upper part of the opening 9*a*. FIG. 2 shows a state of the developing unit 4 in which the developer container 9 is attached thereon, and FIG. 3 shows another state of the developing unit 4 in which the developer container 9 is detached. In the embodiment shown in these Figures, the developer container 9 is attached to the developing unit 4 by inserting right side (FIG. 1) convex hooks 9*c* which project from the developer container 9, into an opening on the right side (FIG. 1) hooking portion 4*b* formed in a casing of the developing unit 4, and by inserting the left side (FIG. 1) convex hooks 9*b* of the developer container 9 into an opening on the left side (FIG. 1) hooking portion 4*a*, so that the developer container 9 can be detachably mounted on the developing unit 4.

FIG. 1 shows the developer container 9 in a state just after being mounted on the developing unit 4. The developer container 9 is sealed with a heat seal 93 provided at an opening of a bottom of the developer container 9. The developer 91 and a dehumidifying agent 92 are contained in an internal part of the developer container 9 while being sealed. In this state, the developer 91 can flow in the developer container 9. However, the dehumidifying agent 92 is fixed at an internal top wall of the developer container 9 using, for example, an adhesive agent so that the dehumidifying agent does not fall down. The heat seal 93 can easily be pulled out from the developer container 9 in the state shown in FIG. 1. Since the developer container 9 communicates with the developing unit 4 when the heat seal 93 is pulled off, the developer 91 in the developer container 9 falls into the developing unit 4 while the dehumidifying agent 92 remains in the developer container 9. The developer 91 is then supplied onto the developing sleeve 41 to be used for developing while being agitated by the first agitating roller 42 and the second agitating roller 43. The dehumidifying agent dehumidifies the internal area of the developing unit 4, to prevent the charge of the developer 91 from decreasing due to moisture in the air.

A portion of the toner in the developer 91 which falls into the developing unit 4 is consumed during each developing operation. The toner density of the developer 91 is detected by a toner-density detecting sensor 46 mounted beneath the second agitating roller 43. If the toner density is detected to be insufficient by the toner-density detecting sensor 46, the toner is supplied from a toner bottle 101 in the toner supplying device 100 to the developing unit 4. A suitable toner-density detecting sensor includes a permeability sensor which detects the toner density by measuring the permeability of the developer 91.

In the aforementioned toner supplying device 100, a toner supplying opening 100*a* is formed at an end of a front side of the toner bottle 101 for discharging the toner which is contained in the toner bottle 101, and a spiral rib is formed at an internal peripheral surface of the toner bottle 101 for leading the toner contained therein towards the toner supplying opening 101*a*. In the toner supplying device 100, a rotation driving power of a bottle motor (not shown) which is turned on when required is transmitted by a drive transmission system composed of a gear and the like to drive the toner bottle 101. When the toner bottle 101 rotates, the toner in the toner bottle 101 is fed to a casing part 100*b* from the toner supplying opening 101*a*. The toner discharged towards the casing part 100*b* is fed through the path indicated by an open arrow in the FIG. 1 and then supplied from the toner supplying opening 100*a* to the developing unit 4.

Figure 4:
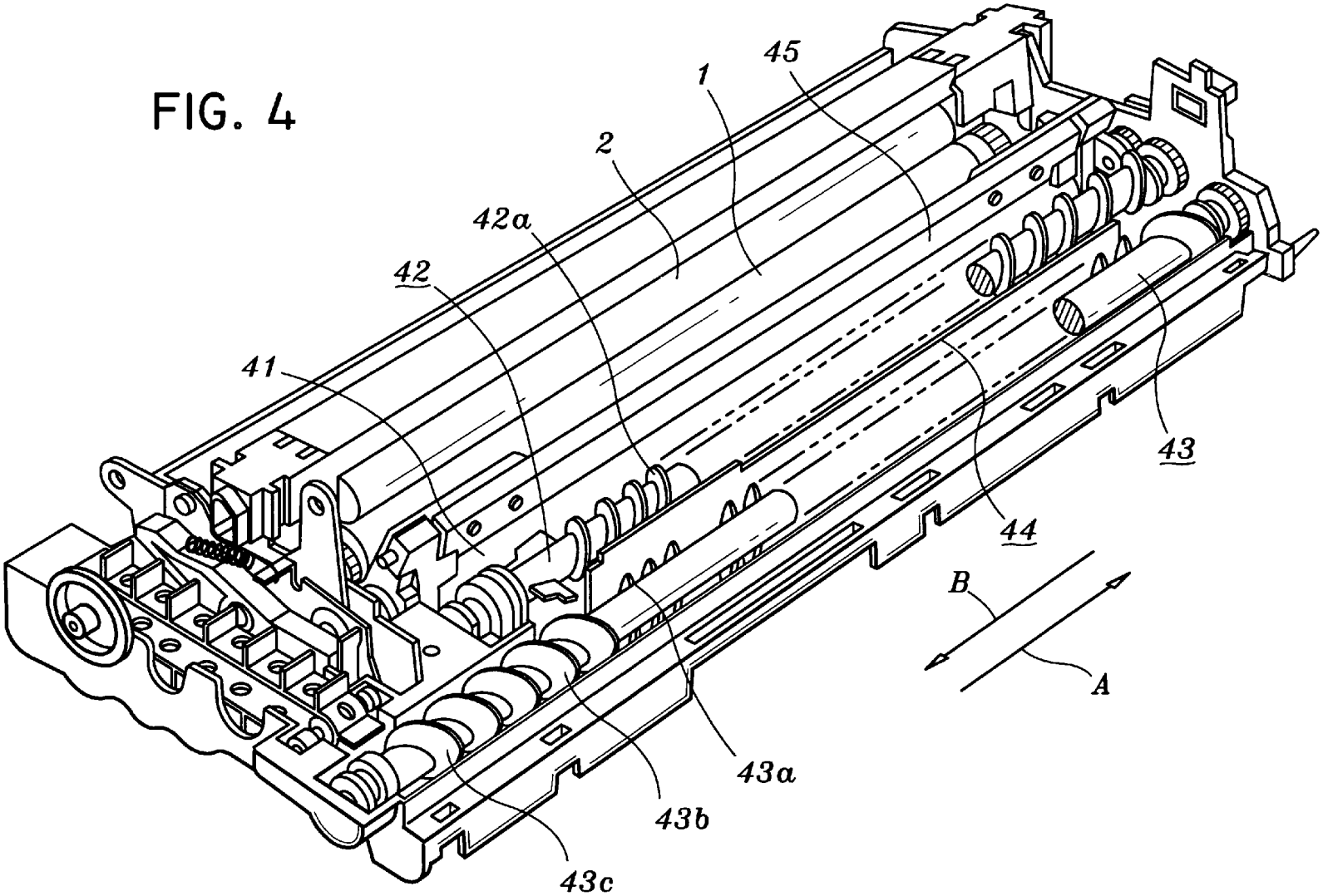
FIG. 4 is a perspective illustration showing an internal construction of the developing unit illustrated in FIG. 2.

Next, agitation and conveyance of the developer 91 in the developing unit 4 is explained in detail using FIG. 4. FIG. 4 is a perspective illustration showing an internal construction of the developing unit 4. The aforementioned second agitating roller 43 is longer than the first agitating roller 42, and extends towards the front side of the developing unit 4, and a screw is formed on an outer peripheral surface of the extended part of the second agitating roller 43. A plurality of chip plates 43*a* having a shape like a half-ellipse are mounted on a part of an outer peripheral surface of the second agitating roller 43 which is adjacent to the first agitating roller 42 via the partition plate 44 so that the chip plates 43*a* are set diagonally across the shaft of the second agitating roller 43, and agitate and convey the developer 91 according to the rotation of the second agitating roller 43. By the relation of the second agitating roller 43, the developer 91 is conveyed in the direction indicated by an arrow A in FIG. 4. Similarly, a plurality of chip plates 42*a* having the same shape as chip plates 43*a* are mounted on an outer peripheral surface of the first agitating roller 42 so that the chip plates 42*a* are set diagonally across the shaft of the first agitating roller 42. The slant of the chip plates 42*a* is opposite in direction to the slant of the chip plates 43*a*, and the developer 91 is conveyed in the direction indicated by an arrow B in FIG. 4 by the rotation of the first agitating roller 42.

The developing sleeve 41 of the developing unit includes a hollow cylinder made of a non-magnetizable material, and a secured shaft having five poles is provided therein. The developing sleeve 41 is rotated by a drive part (not shown). The developer 91 is attracted onto a surface of the developing sleeve 41 by magnetic force when the developer is conveyed by the first agitating roller 42 in the direction indicated by the arrow B in the internal part of the developing sleeve 41. The developing sleeve 41 conveys the developer 91 while rotating and attracting the developer 91 by magnetic force, and the developer 91 is supplied to the facing position of the developing sleeve 41 and the photoconductive element 1 to develop the latent image on the photoconductive element 1 after being regulated by a doctor blade 45.

A front gap and a rear gap for passing the developer 91 are provided between the front and rear end surfaces of the partition plate 44 which is set between the first agitating roller 42 and the second agitating roller 43 in the longitudinal direction of the developing sleeve 41, and internal surfaces of the front and rear side walls of the developing unit 4. The developer 91 which is conveyed by the aforementioned first agitating roller 42 in the direction indicated by the arrow B and which remains because of not being supplied onto the surface of the developing sleeve 41, moves towards an agitating area of the second agitating roller 43 through the front gap of the developing unit. The developer 91 is conveyed by the second agitating roller 43 in the direction indicated by an arrow A and then moves towards another agitating area of the first agitating roller 42 through the rear gap. Thus, the developer 91 is circulated around the partition plate 44 by the first agitating roller 42 and the second agitating roller 43.

If the toner-density detecting sensor 46 detects that the toner density of the developer 91 in the developing unit 4 decreases, the toner in the toner bottle 101 on the toner supplying device 100 is supplied into the developing unit 4 from the toner supply opening (not shown) while a shutter 47 which is shown in FIGS. 2 and 3 and mounted for covering the toner supplying opening is opened. The supplying position of the toner is, as shown in FIG. 4, located at a position above the screw part 43*b* which is relatively close to the inner side of the second agitating roller 43, i.e., relatively close to a rear part of the extended part of the shaft of the second agitating roller 43. Onto the screw part 43*c* which is placed closer to the front side part of the developing unit 4 than the screw part 43*b* mounted on the second agitating roller 43, the remaining toner (hereinafter referred to as recycling toner) which is scraped off from the photoconductive element 1 is conveyed for recycling.

The recycling toner which is conveyed to the screw part 43*c* of the second agitating roller 43 is then mixed with the new toner supplied from the toner supplying device 100 at the aforementioned toner supplying position close to the rear end part of the screw part 43*c* in a longitudinal direction. The mixed toner of the recycling toner and the new toner is then mixed with the developer 91 at the position of the second agitating roller 43 close to the rear end part of the screw part 43*c* in the longitudinal direction in the loop-like path for circulation and conveyed while being agitated by the chip plates 43*a* of the second agitating roller 43. Since the mixed toner has an insufficient charge at an early stage of agitation, it is undesirable for the toner having an insufficient charge to be supplied to the developing sleeve 41 by movement towards the agitating area of the first agitating roller 42 across the partition plate 44. Therefore, a part of the partition plate 44 which is adjacent to the area in which the early stage of the agitation of the developer 91 is performed by the aforementioned second agitating roller 43 is formed higher than the other part of the partition plate 44 to prevent the aforementioned movement of the developer 91 across the partition. A main controller (not shown) including a CPU is used for controlling each section for performing an image forming operation in this copying machine. Signals from an operation panel (not shown) which has a display, and an operation part composed of a plurality of keys to be operated by a user, signals from the aforementioned toner-density detecting sensor 46 and the like signals are input to the main controller, and each part of the copying machine is controlled using these signals.

Figure 5:
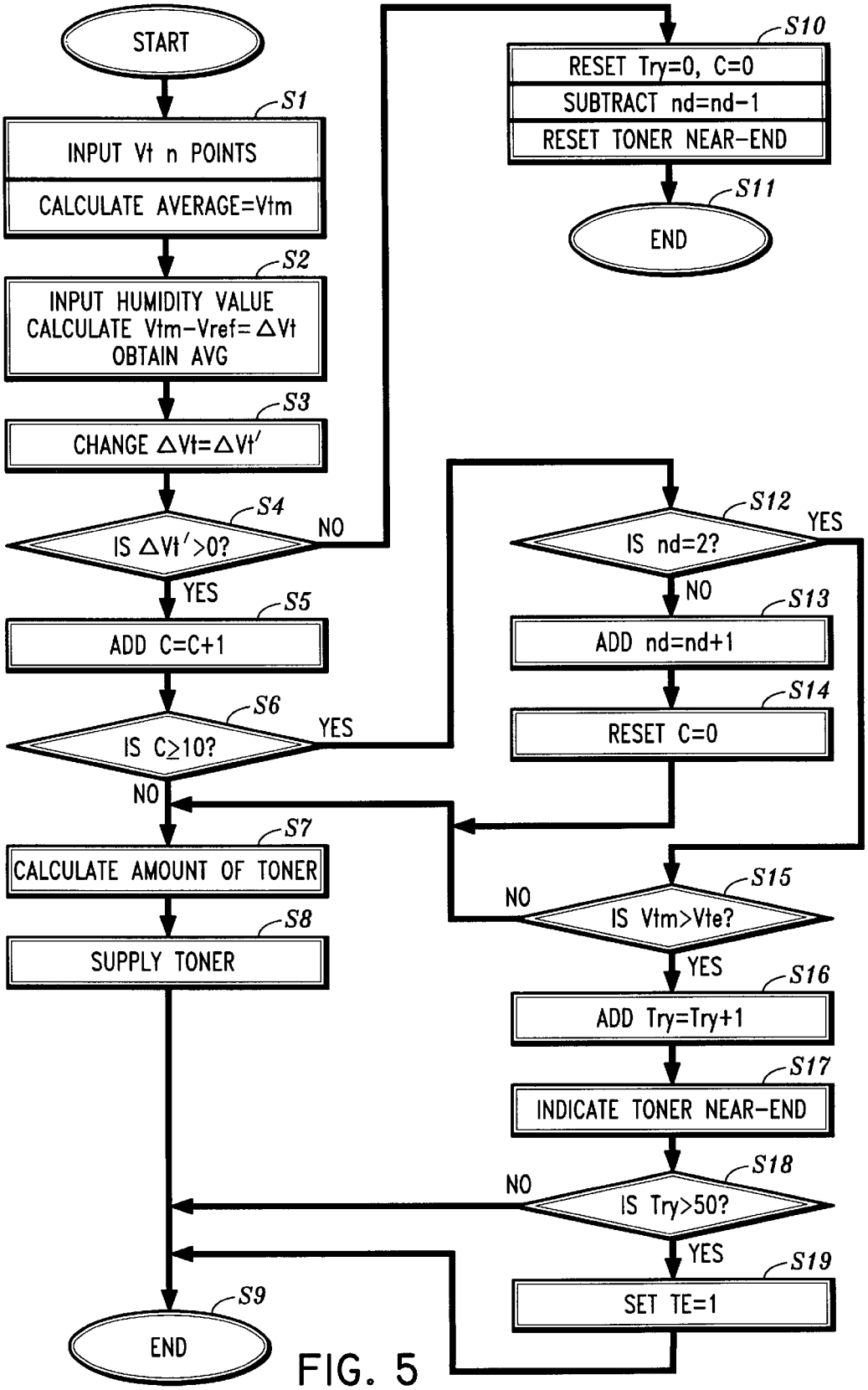
FIG. 5 is a flowchart showing an embodiment of toner supply controlling of the copying machine of the present invention when an image forming operation is performed.

Next, a toner supply controlling operation of the copying machine is explained by reference to FIG. 5. FIG. 5 is a flowchart of the toner supply controlling operation performed by the main controller at a predetermined timing. For example, the toner supply control operation can be performed after an image forming operation for each transfer sheet. When the toner supply controlling operation starts after the image forming operation is finished, the main controller samples data for a plurality of output values (Vt) of the toner density (n points) from the toner-density detecting sensor 46, and then averages the n points of the output values Vt to obtain an average value (Vtm) (step S1). Next, a toner-density reference value Vref, is subtracted from the average value Vtm to obtain a difference ΔVT which is calculated from the following equation (step S2):

$$\Delta VT = Vtm - Vref.$$

Next, the main controller samples data for a plurality of output values of humidity input by the humidity sensor to obtain an average value. Then, the difference ΔVt is corrected based on the average humidity value to another difference value ΔVt' to compensate for variations in the humidity. This correction is performed so that the charging amount of the toner becomes stable at a predetermined value without variation of the charging amount of the toner due to the humidity (step S3). The range of humidity in which the main controller corrects the difference ΔVt in accordance with the average humidity value which is based on the output values from the humidity sensor is a range of humidity in which the relationship between the humidity and the output value from the humidity sensor is approximately linear.

The main controller then judges whether the corrected value ΔVt' is greater than 0 (step S4). At this point, the higher the toner density becomes, the smaller the output value Vt of the toner-density detecting sensor 46. Therefore, if the aforementioned ΔVt' is lower than 0, (NO, in step S4) the toner density is higher than the predetermined toner-density reference value. In this case, the main controller resets count values Try and C to 0, and subtracts one from the toner supplying level nd (i.e., drops the toner supplying level nd by 1 rank). If the toner in the developer 91 is in a near-end state, the main controller resets a toner near-end flag (step S10), and ends the program of the toner supply controlling operation (step S11).

On the other hand, when ΔVt' is greater than 0 (YES in step S4), i.e., the toner density is lower than the toner-density reference value, the main controller adds one to the count value C (step S5), and then judges whether the new count value is greater than a predetermined value, for example, greater than or equal to 10 (step S6).

If the new count value C is not greater than or equal to the predetermined value (NO in step S6), this means that the image forming operation has not been performed more than or equal to 10 times under the condition of the toner density being lower than the toner-density reference value. In this case, the main controller calculates an amount of the toner to be supplied to the developing unit 4 by the toner supplying device 100 (step S7). The amount of the toner to be supplied is changed in accordance with the toner supplying level nd, and the larger the level nd becomes, the more the amount of the toner to be supplied. The toner of the amount to be supplied is then supplied by controlling the toner supplying device 100 (step S8), and a program for toner supply controlling operation ends (step S9).

When the count value C is judged to have reached the predetermined value in step S6 (YES in step 6), the main controller judges whether the toner supplying level nd is 2 (step S12). If nd is not 2 (NO in step 12), the level nd is incremented by one (step S13) and the program proceeds to step S7 after resetting the count value C to 0 (step 14). If the toner supplying level nd is judged to be 2 (YES in step S12), the main controller judges whether the average value Vtm is higher than a predetermined toner-end value Vte (step S15).

If the average value Vtm is lower than the toner-end value Vte (NO in step S15), the program returns to the aforementioned step S7. If the average value Vtm is higher than the toner-end value Vte (YES in step S15), the toner supplying device 100 is judged to have reached the toner near-end state. The main controller then adds one to the count value Try (step S16). The main controller then directs a display in the operation panel (not shown) to indicate that the toner supplying device 100 has reached the toner near-end state (step S17). The main controller then judges whether the count value Try is greater than a predetermined set value, for example, 50 (step S18).

If the count value Try is equal to or less than the predetermined set value, the main controller ends the program of the toner supplying operation (step S9). On the other hand, if the count value Try is greater than the set value, namely, if the image forming operation has been continuously performed 50 times under the condition of Vtm>Vte, the toner supplying device 100 is judged to have reached the toner-end state, and the main controller sets a toner-end flag TE to 1 (step S19) and ends the program of the toner supplying operation (step S9). If the toner-end flag TE is equal to 1, the main controller directs the display in the operation panel to indicate that the toner supplying device 100 has reached the toner-end state, and resets the toner-end flag TE to 0 after the toner bottle is exchanged.

Thus, the toner supplying operation is performed during the image forming operation in this copying machine.

If the charge amount or the bulk of the developer 91 has decreased after the copying machine has been left without being used, information of the decrease of the toner density is output by the toner-density detecting sensor 46 while the toner density does not vary. In the copying machine of the present invention, the toner-density reference value Vref is set to about 2.0V, and the output value of the toner-density detecting sensor 46 is controlled to be about 2.0V when the image forming operation is performed. The lower the toner density, the higher the output value of the toner-density detecting sensor 46 becomes. Accordingly, the average output value whose level is 2.0V when the image forming operation is performed prior to the device being left unused for an extended period of time increases to a greater value, for example, 2.4V when the device is left without being used for a week. If the toner supply controlling operation is performed until the output value of the toner-density detecting sensor 46 reaches 2.0V according to the output value of 2.4V, the toner density reaches a higher than desired value. Since toner scattering or background soil tends to occur due to deterioration of the charge amount of the toner when the copying machine is left without being used for an extended period of time, such problems further tend to occur because the toner density is higher than the desired value.

Figure 6:
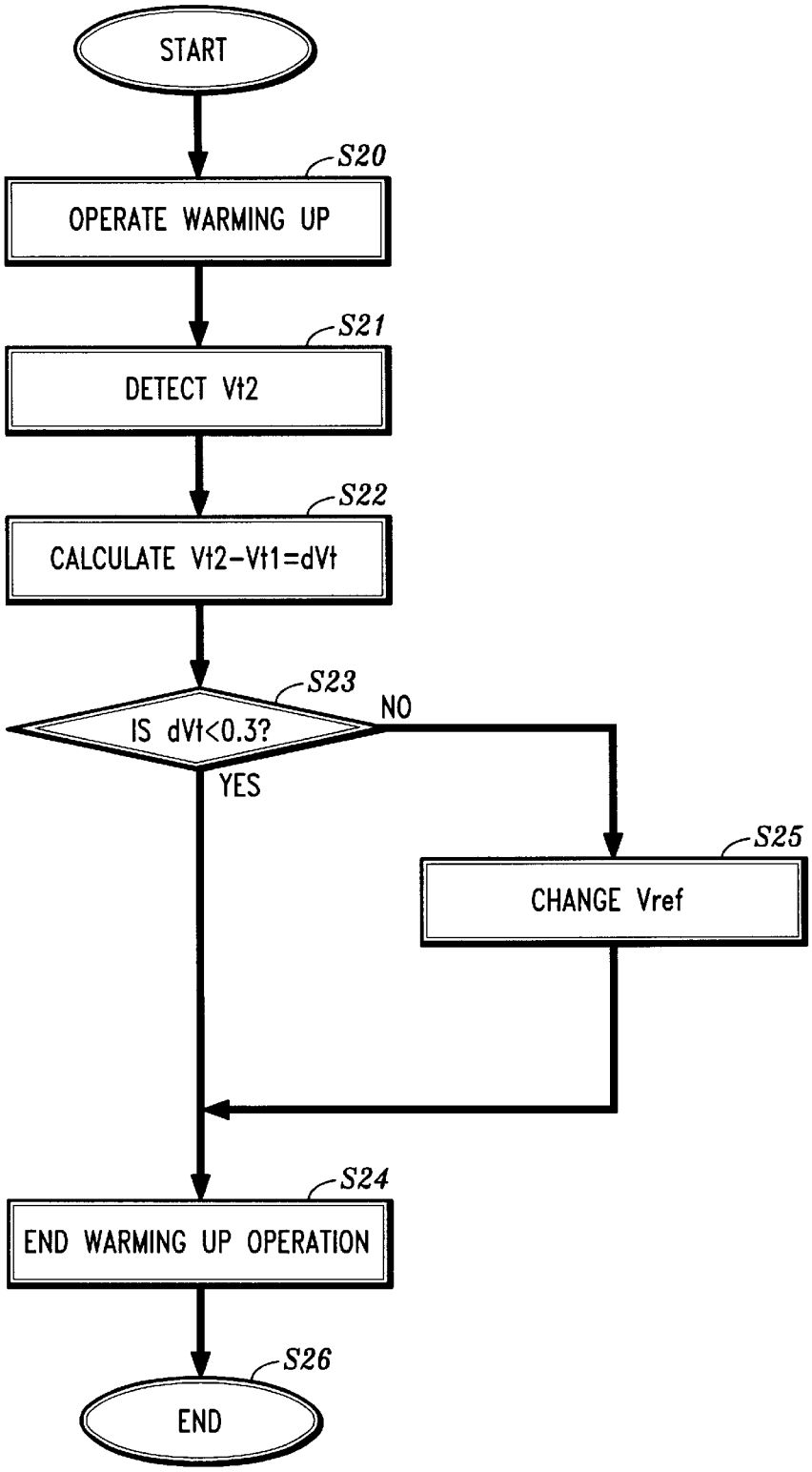
FIG. 6 is a flowchart showing an embodiment of toner supply controlling of the copying machine of the present invention when the copying machine is warmed up.

The copying machine of this embodiment of the present invention can perform an image forming operation without occurrence of toner scattering or background fouling even when the image forming operation is performed after the copying machine is left for an extended period of time without being used. This image forming operation is explained hereinbelow by reference to FIG. 6.

In the step S1 (FIG. 5) which is performed during the image forming operation, the average output value Vtm which is obtained by sampling and averaging a plurality of output value data Vt output by the toner-density detecting sensor 46, is stored in an internal memory of the main controller as an average output value Vt1 during the image forming operation. This average output value Vt1 is updated every image forming operation for each transfer sheet. When, for example, the main switch of the copying machine is turned on and the image forming operation is initially directed to start after the copying machine has been left without being used, a warm-up operation is performed (Step 20). More specifically, a preparatory operation such as preliminary rotation of the developing sleeve is started before the image forming operation in which an image is formed on an image bearing member according to image information. Next, an average output value Vt2 is obtained by sampling a plurality (n points) of output value data Vt output by the toner-density detecting sensor 46 and averaging the data (step S21). The average output value Vt2 is then compared to the average output value Vt1 from the previous image forming operation stored in the internal memory to obtain the differential value dVt which is the difference between Vt1 and Vt2 (dVt=Vt2−Vt1) in (step S22).

As mentioned previously, when the copying machine is left without being used and the bulk of the developer 91 decreases, the output value of the toner-density detecting sensor 46 increases, resulting in an increase in the differential value dVt. In the present invention, the toner-density reference value Vref changes in accordance with the differential value dVt. The main controller at first judges whether the differential value dVt which is obtained in step S22 is less than 0.3 (step S23). If the differential dVt is less than 0.3 (YES in step S23), namely, if there is substantially no change between the output value output by the toner-density detecting sensor 46 before and after the copying machine is left without being used, the warm-up operation ends (step S24) and the image forming operation is performed without changing the toner-density reference value Vref.

On the other hand, if the differential value dVt is higher than 0.3 (NO in step S23), the toner-density reference value Vref is changed (step S25) and the warming up operation ends (step S24). It is desirable that the change to the toner-density reference value Vref be performed according to the magnitude of the differential value dVt. For example, if the differential value dVt is equal to or greater than 0.3 and lower than 0.4, the toner-density reference value Vref is set to be a value greater than the previous value (about 2.0) by 0.3V. If the differential value dVt is equal to or higher than 0.4 and lower than 0.5, the toner-density reference value Vref is set to be a value greater than the previous value by 0.4V. If the differential value dVt is equal to or greater than 0.5 and lower than 0.6, the toner-density reference value Vref is set to be a value greater than the previous value by 0.5V, and if the differential value dVt is greater than 0.6, the toner-density reference value is set to be a value greater than the previous value by 0.6V. Thus the warm-up operation ends (step S24), the procedure then ends (steps S26) and the image forming operation starts and the toner supplying operation shown in FIG. 5 is performed on the basis of the changed Vref (hereinafter referred to as Vref' when necessary). An occurrence of toner scattering and background fouling due to the excess supply of the toner on the basis of the false detection by the toner-density detecting sensor 46 can be prevented, since the toner supply is hardly performed in comparison with the case in which the toner supply is controlled on the basis of the value of Vref which is not. Further, since the toner is hardly supplied, an agitating coefficient increases because the amount of the developer 91 does not increase, and since the toner density is hardly increased, friction between the carrier and the toner can be easily produced, resulting in an increase of the charge amount of the toner. Therefore, the occurrence of toner scattering or background soil can further be prevented.

Furthermore, since using a result of the toner-density detected at the warm-up operation before the image forming operation, a waiting time until the first image forming operation starts becomes relatively short, compared to using the result of the toner density which is detected just after starting the image forming operation.

If a continuous image forming operation for producing dozens of copied sheets is performed after the copying machine has been left without being used, the charge amount or the bulk of the toner tends to be recovered by agitating the toner during the image forming operation. In this case, if the toner supply controlling operation is still performed using the changed toner-density reference value Vref' even after a proper toner-density can be detected by the toner-density detecting sensor 46, an image density tends to become thinner than the required image density. Therefore, it is desirable that after the image forming operations for a predetermined number of sheets are performed using the changed toner-density reference value Vref, the toner-density reference value Vref' should be returned to the previous value.

Figure 7:
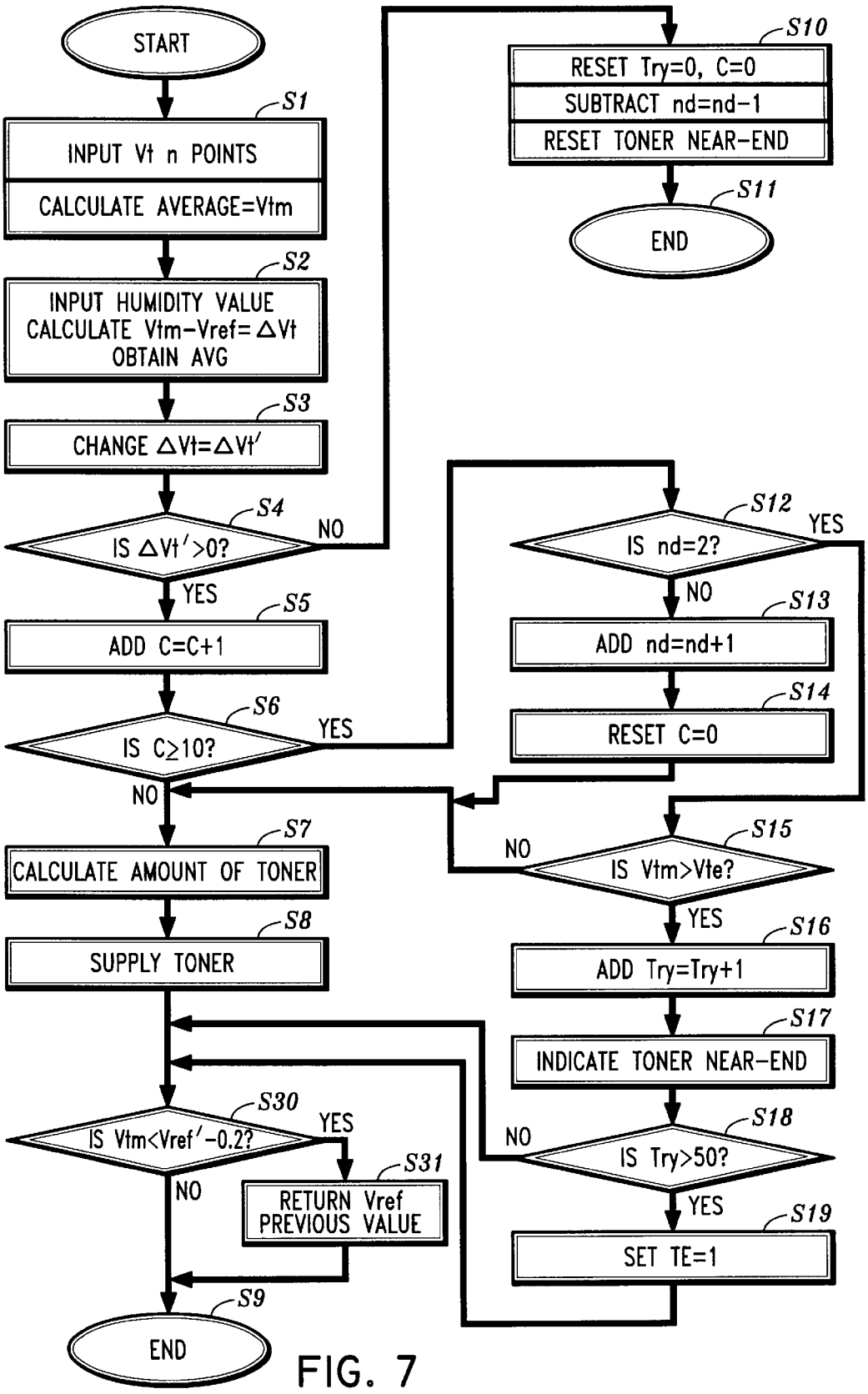
FIG. 7 is a flowchart showing a variation of the toner supply controlling of the copying machine of the present invention when the image forming operation is performed.

FIG. 7 is a flowchart showing an example of the toner-density controlling operation described above. FIG. 7 is similar to FIG. 5. Steps S1–S19 are identical in the two figures and therefore, these steps will not be described in detail. The difference between FIG. 7 and FIG. 5 is that a process for comparing the output average value Vtm from the toner-density detecting sensor 46 with the changed toner-density reference value Vref' is inserted just before the finish of the toner supply controlling operation. More specifically, after the toner is supplied in step S8, the main controller judges whether the average value Vtm of the values Vt output by the toner-density detecting sensor 46 is lower than a predetermined threshold value. For example, according to this embodiment of the present invention, a determination is made whether the average value Vtm is lower than the changed toner-density reference value Vref' by 0.2V (step S30), after the toner is supplied in step S8, when the count value Try is equal to or lower than the set value in step S18, or when the toner-end flag TE is set 1 in step S19 (step S30). If the developer 91 is agitated and the bulk thereof increases by performing the continuous image forming operation, the average value Vtm decreases. Generally, when a continuous image forming operation for producing about 50 sheets is performed, the average value Vtm of the output value Vt output by the toner-density detecting sensor 46 becomes low. That is, the average value Vtm is at least 0.2V lower than the changed toner-density reference value Vref' (yes in step S30), and the charge amount or the bulk of the developer 91 is considered to be recovered to the state before decreasing. Therefore, a proper toner-density is considered to be able to be detected by the toner-density detecting sensor 46. Accordingly, if the average value Vtm becomes lower than the threshold value (YES in step S30), the main controller returns the toner-density reference value Vref to the value before the change (step S31), and then ends the toner supply controlling operation (step S9). If the number of sheets on which an image is continuously formed is smaller than a predetermined number, and the average value Vtm is judged to be higher than the threshold value (NO in step S30), the main controller ends the toner supply controlling operation (step S9).

As mentioned above, toner scattering or background fouling can be prevented by controlling the toner supply by changing the toner-density reference value Vref during the continuous image forming operation of a predetermined number of sheets (50 sheets in this case), which causes an increase of the agitating efficiency of the developer.

In addition, even when performing continuous image forming operations producing dozens of copy sheets after the copying machine is left without being used, a problem can be avoided in which the image density becomes thinner than the required density due to excessively performing the toner supply control using the changed toner-density reference value Vref', although the toner-density detecting sensor 46 has become capable of detecting the proper toner density. This problem can be avoided by returning the changed toner-density reference value Vref' to its previous value before changing and the toner supply amount to the previous level, after the toner-density detecting sensor 46 has become capable of detecting the proper toner density which allows the device to recover the charging amount and the bulk of the developer 91 in the developing unit in combination of agitation by the continuous image forming operation.

The above-mentioned embodiment of the toner density controlling is performed so that the threshold value for controlling the amount of toner supply is set by using the toner-density reference value Vref' until about 50 sheets pass after the copying machine starts the continuous image forming operation. This is performed regardless of the amount of decrease in the charging amount or the bulk of the developer 91 due to the copying machine being left without being used for an extended period of time. However, the threshold value may be set corresponding to the amount of decrease of the charging amount or the bulk of the developer 91 caused by the copying machine being left without being used. When the copying machine has been left for a relatively short period of time and the decrease of the charging amount or the bulk of the developer 91 is relatively small, a variation of the output value from the toner-density detecting sensor 46 between before and after leaving of the copying machine is small. In this case, the threshold value is set to a value so that the time period for controlling the amount of toner supply becomes relatively short, and vice versa. By performing such a toner controlling operation, the amount of the toner supply can be returned to a previous level when the charging amount or the bulk of the developer 91 is recovered. Therefore, an image forming operation capable of producing copied sheets having a desired image density can be performed.

In addition, a toner supply control program is available in which the recovery of the charge amount or the bulk of the developer 91 is performed when it is judged that the number of copied sheets counted with a counter provided with the copying machine reaches a predetermined number of sheets after the toner-density value Vref has been changed. More specifically, the counter is reset when the toner-density reference value Vref is changed during the warm-up operation, and the toner supply operation is performed using the changed toner-density reference value Vref' until the number of copied sheets reaches the predetermined number. The main controller then returns the changed toner-density reference value Vref' to the pervious value after copying the predetermined number of sheets. In this case, the predetermined number of sheets is desirably changed in accordance with a decrease of the charge amount or the bulk of the developer 91.

Furthermore, a toner supply control program is available in which a controlling time for controlling the toner supply amount is measured by a timer provided with the copying machine. More specifically, the timer is reset when the toner-density reference value Vref is changed during the warm-up operation, and the toner supply control is performed using the changed toner-density reference value Vref' during a preset time period. The main controller then returns the changed toner-density reference value Vref' to the previous value Vref after the preset time period has passed by. In this case, it is desirable that the preset time period be changed in accordance with a decrease of the charge amount or bulk of the developer 91.

Furthermore, a toner supply control program is available in which the toner supply amount is corrected from a first toner supplying operation in accordance with a result of comparison of the result of detection of the toner density at the warm-up operation and the result of the detection of the toner which is stored in memory.

In a copying machine having such construction, since the proper toner supplying operation is performed in accordance with the toner density of the developer 91 from the first toner supplying operation, toner scattering or background fouling due to the excessive toner supply can be prevented.

In attempting to solve the above-mentioned problems which occur when the copying machine is left for a long period of time without being used, various methods have been proposed. For example, one method has been proposed in which the excess toner supply is prevented by determining a toner supplying time using a detected value of a toner-density detecting sensor at a finishing time of a previous operation of the developing unit instead of using the detected value of the toner-density sensor at a starting time of the operation of developing unit, until the output value of the toner-density detecting sensor becomes stable. Another method has been proposed in which the excess toner supply is prevented by setting the upper limit of an amount of the toner supply, which is determined by using the detected value of the toner-density sensor, to be relatively low. However, the former method cannot respond to variations of the toner density by toner consumption until the output value of the toner-density detecting sensor becomes stable, and the latter method has a shortcoming in that a toner supplying operation is performed despite being the proper toner density.

In contrast, in the copying machine of the present invention, the toner is supplied on the basis of the difference between the detected value of the toner density detected by the toner-density detecting sensor 46 and the toner-density reference value Vref, and the toner-density reference value Vref is changed in accordance with the result of comparison of the toner-density value detected during the warm-up operation the detected value which is stored in memory.

Therefore, in the copying machine having the above described construction, since the toner-density reference value is changed in accordance with the result of the comparison of the toner density, the copying machine can avoid the problem in which a toner supplying operation is performed despite being the proper toner density when the copying machine starts the image forming operation while responding to the variation of the toner density due to toner consumption during the developing operation.

Next, an image forming apparatus according to another embodiment of the present invention will be described.

The construction of this image forming apparatus is approximately the same as that of the copying machine shown in FIG. 1 through FIG. 4, and only the characteristic parts thereof are explained hereinbelow, with the explanation of the other parts being omitted.

Figure 8:
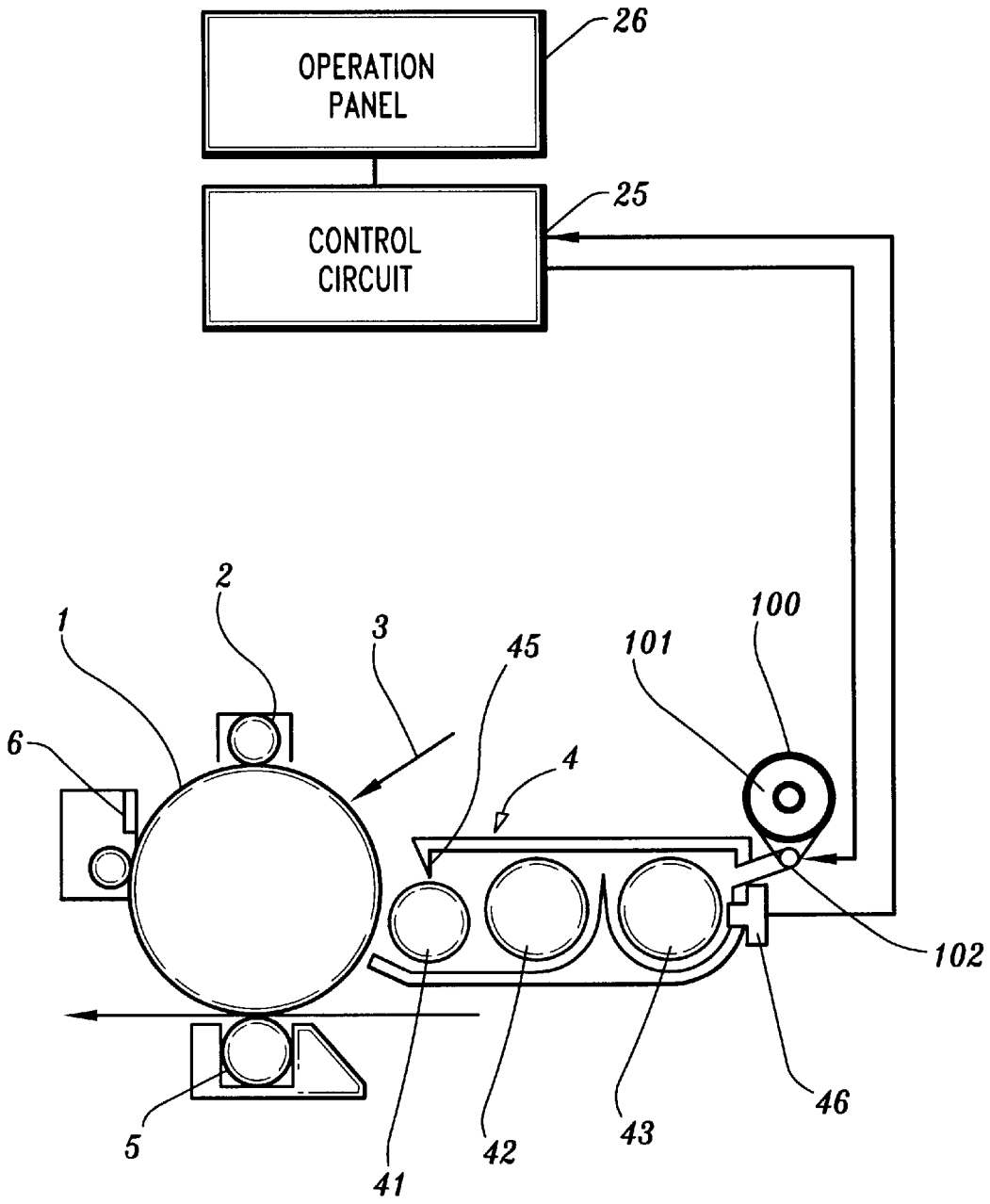
FIG. 8 is a block diagram of a toner-density controlling device for another embodiment of the copying machine of the present invention.

As shown in FIG. 8, a toner supplying device 100 supplies the toner from a toner bottle 101 to the developing unit 4 by movement of a toner supply drive part 102 composed of a motor or a clutch and which is controlled by an image forming apparatus control circuit 25 including a CPU. The operation panel 26 has an operational part which is composed of a plurality of keys operated by a user, and a display part. The image forming apparatus control circuit 25 performs the image forming operation by controlling each part of the image forming apparatus using an input signal from the operation panel 26 or the like, and further performs the toner supply control or the agitation control of the developer 91.

Figure 9:
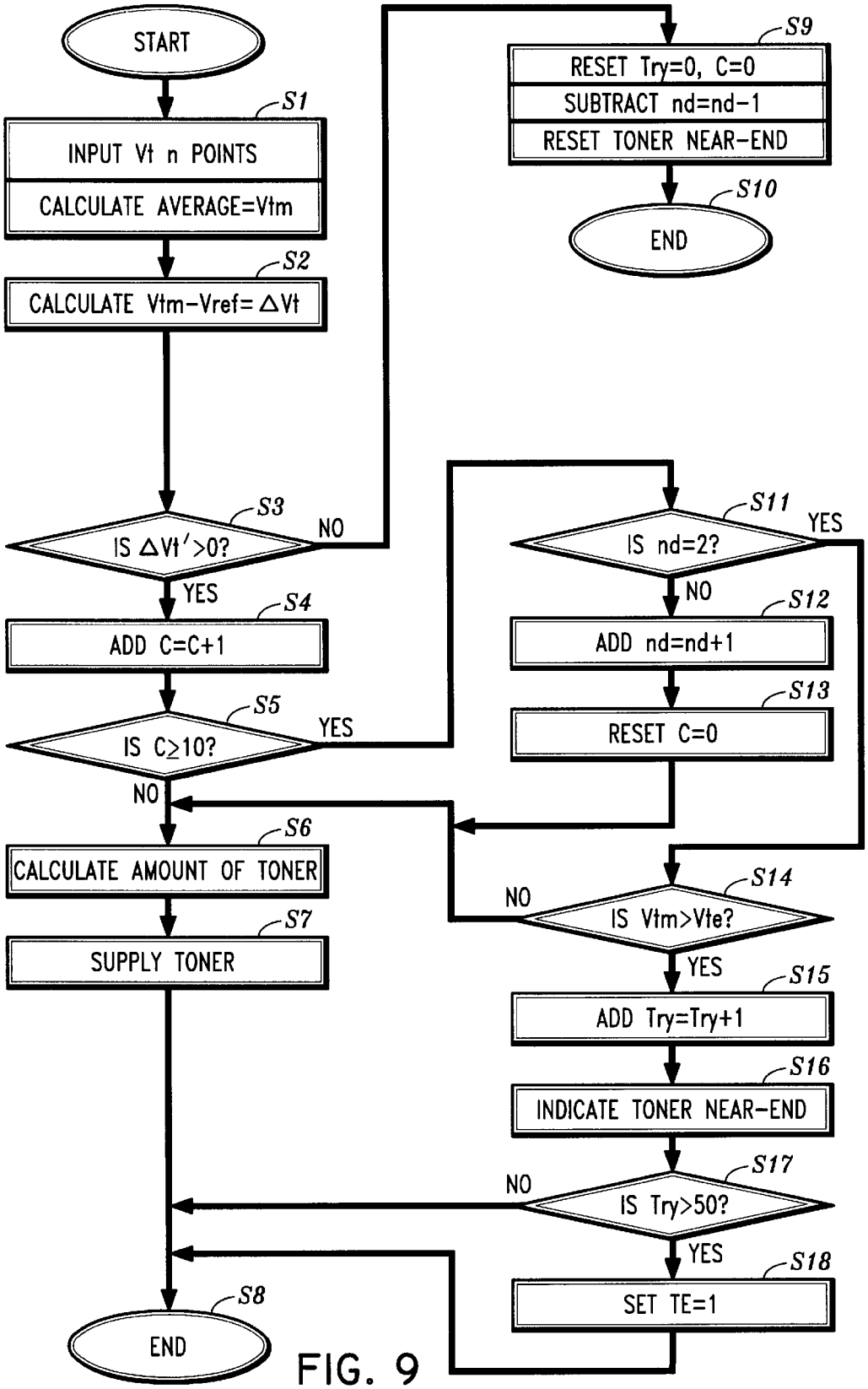
FIG. 9 is a flowchart showing an embodiment of toner-density controlling of the copying machine illustrated in FIG. 8 when the image forming operation is performed.

The toner supply control performed by the image forming apparatus control circuit 25 is explained using FIGS. 8 and 9.

The image forming apparatus control circuit 25 executes a program shown in FIG. 9 after each image forming operation producing one copied sheet.

The image forming apparatus control circuit 25 at first samples a plurality of data (n points) of output values (Vt) output by the toner-density detecting sensor 46, to obtain an average (Vtm) of the output values Vt (step S1). Next, the control circuit 25 compares the average Vtm and a toner-density reference value Vref, to obtain a difference ΔVT thereof (step S2).

$$\Delta VT = Vtm - Vref$$

In step S3, the control circuit 25 judges whether the difference ΔVT is equal to or greater than 0. At this time, the higher the toner density, the smaller the output value Vt of the toner-density detecting sensor 46. If ΔVt is less than 0, namely, if the toner density is higher than the toner-density reference value (i.e., Vtm>Vref), the control circuit 25 resets the count data Try and C to 0 and subtracts one from the toner supply level nd in step S9. Further, if the toner in the developer 91 is in a near-end state, the control circuit 25 resets the near-end 0, and ends the program of the toner supply control in step S10.

Further, if ΔVT becomes greater than 0 (ΔVt>0), that is, if the toner density becomes lower than the toner density reference value Vref, the count value C is incremented by one in step S4, and the control circuit 25 judges whether the count value C is greater than or equal to a set value. For example, if the set value is 10, it is determined whether the count value C is equal to or greater than 10 (C≧10) in step S5.

If C is less than 10, that is, a number of continuous image forming operations performed under the condition of ΔVt being less than 0 is not equal to or greater than 10, the control circuit 25 calculates the amount of toner to be supplied to the developing unit 4 from the toner supplying device 100 in step S6. In this case, the control circuit 25 changes the amount of toner to be supplied to the developing unit 4 from the toner supplying device 100 according to the toner supplying level nd so that the larger the level nd becomes, the more the amount of toner to be supplied is increased.

Then, the control circuit 25 controls the toner supply drive part 102 to supply the calculated amount of toner in the toner supplying device 100 to be supplied (step S7), and ends the program of the toner supplying control in step S8.

Furthermore, if C becomes 10 or greater, (C≧10), the control circuit 25 judges whether the toner supply level nd is 2 in step S11. If nd is not 2, the control circuit adds one to the toner supply level nd (step S12), resets the count value C to 0 (step S13) and then proceeds to step S6. If the toner supply level nd becomes 2, the control circuit 25 judges whether the value Vtm is greater than the toner-end value Vte in step S14.

If Vtm is not greater than Vte, the control circuit 25 proceeds to step S6, and if Vtm becomes greater than Vte (Vtm>Vte), the control circuit 25 judges that the toner supplying device 100 is at a near-end state. The control circuit 25 then adds one to the count value Try in step S15, judges whether the count value Try is greater than a set value, for example, 50 in step S17, after making the display of the operation panel 26 indicate that the toner supplying device 100 is at a toner end state in step S16.

If Try is not greater than 50 in Step S17, the control circuit 25 proceeds to Step S8 and ends the program of the toner supply control. If Try is greater than 50, namely, if the number of continuous image forming operations exceeds 50 times under the state of Vtm being greater than Vte, the control circuit 25 judges that the toner supplying device 100 is at the toner-end state, and sets the toner-end flag TE to 1 in step S18 and the program ends the toner supply control in step S8.

In a case of TE=1, the control circuit 25 makes the display part of the operation panel 26 indicate that an exchange of the toner bottle 101 is necessary, and resets TE to 0 after the toner bottle 101 has been exchanged.

Figure 10:
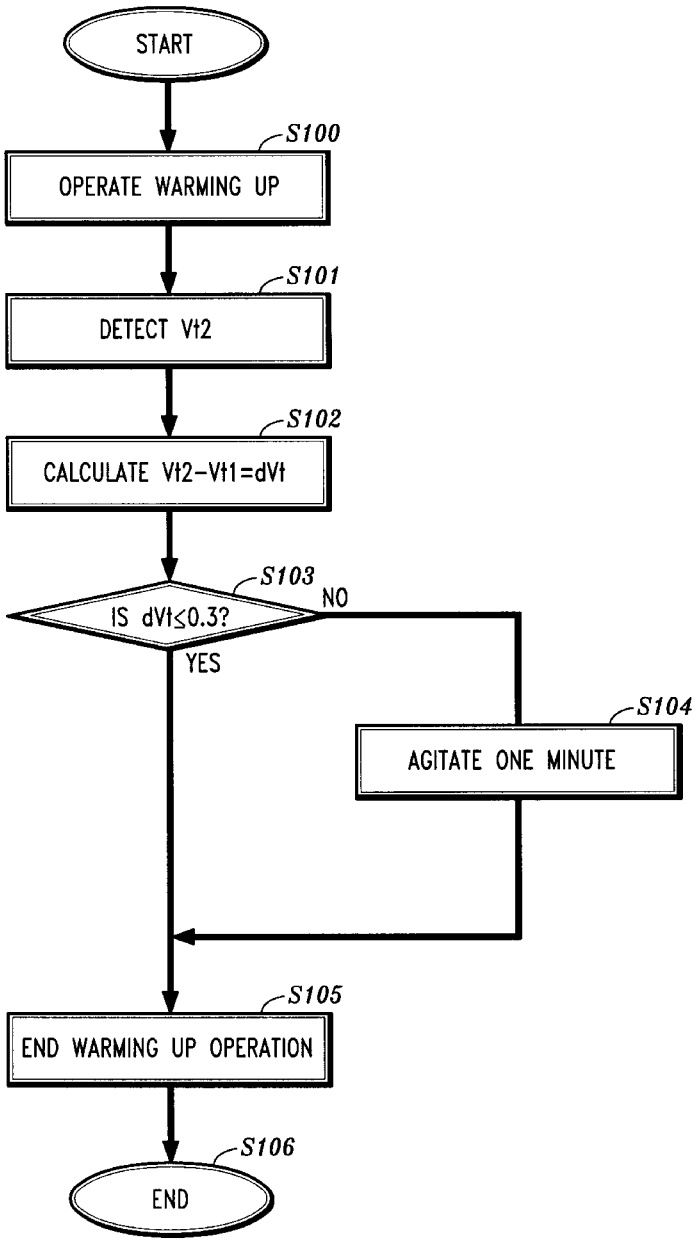
FIG. 10 is a flowchart showing a variation of the toner-density controlling of the copying machine illustrated in FIG. 8 when the image forming operation is performed.

FIG. 10 shows a part of a processing flow performed by the control circuit 25 to change an agitating time of the developer 91 in the developing unit 4 according to the result of the comparison between the output value which is detected by the toner-density detecting sensor 46 when the image forming apparatus performs a warm-up operation and the output value of the toner-density sensor which is output in the previous image forming operation of the image forming apparatus.

This flow is performed by the image forming apparatus control circuit 25 shown in FIG. 8. The control circuit 25 executes the process for storing the output value of the toner-density detecting sensor 46 every image forming operation.

A plurality of the output data values Vt from the toner-density detecting sensor 46 are sampled, and the data is averaged to obtain the average value Vt1, and the average value Vt1 is stored in the internal memory. The average value Vt1 is updated for every image forming operation.

Before starting the next image forming operation, the image forming apparatus control circuit performs a warm-up operation (step S100), and an average value Vt2 of the output values of the toner-density detecting sensor 46 is detected during the warm-up operation (step S101).

The average value Vt2 is compared with the output value Vt1 from the previous image forming operation (step S102). This comparing operation is executed by the calculation:

$$Vt2-Vt1=dVt.$$

The value dVt is then compared with a predetermined reference value 0.3 (step S103), and if dVt is greater than 0.3, the program proceeds to step S104. The control circuit 25 performs the agitating operation of the developer 91 for one minute to charge the developer 91. This process of charging the developer 91 is adjusted according to the value of dVt.

More specifically, usually, the output value Vt1 of the toner-density detecting sensor 46 is controlled to be about 2.0V in the image forming operation in this image forming apparatus. However, for example, if the image forming apparatus is left without being used for a week, the output value Vt1 of the toner-density sensor which is 2.0V when the previous image forming operation has ended, changes to, for example, 2.4V despite no change in the toner density. In this case, the toner density is judged to be low in the toner-density controlling operation, and the toner supplying device 100 continues the toner supplying operation until the output value Vt1 of the toner-density detecting sensor 46 is 2.0V. Therefore, the toner density of the developer 91 in the developing unit 4 becomes higher than the desired toner-density value.

To avoid this problem, when the warm-up operation is performed after the image forming apparatus is left without being used, the control circuit 25 judges whether the differential value dVt calculated by the equation, Vt2−Vt1=dVt, is equal to or greater than 0.4V, for example, by comparing the output value Vt2 (for example, 2.4) with the output value Vt1 (2.0V) which was stored when the previous image forming operation was performed.

If dVt is equal to or greater than 0.4, the control circuit 25 does not supply toner to the developing unit 4, but charges the toner by agitating it for a predetermined time period (one minute, in this case) to return the output value Vt2 of the toner-density detecting sensor 46 when the warming up operation is performed, to the average value Vt1.

As described above, when dVt is relatively large, the output value Vt2 of the toner-density detecting sensor 46 is returned to the average value Vt1 by charging the toner by agitation for a predetermined time during the warm-up operation without supplying the toner to the developing unit 4.

However, in this case, if the agitating operation is performed until the output value Vt2 returns to the output value Vt1 which was stored from the previous image forming operation, the warm-up time of the image forming apparatus becomes relatively long.

Therefore, as shown in FIG. 10, if dVt is equal to or less than a reference value 0.3, which is obtained from experience, the control circuit 25 performs no operation, and if dVt is greater than 0.3, the agitating operation for the developer 91 is performed for one minute in step S104 to minimize the time of the warm-up operation. Thus, the toner is appropriately charged by the agitation, and thereby the desirable image quality can be obtained. After step S104, or if the result of Step S103 is yes, the warming up operation ends in step S105 and the procedure ends (step S106).

Figure 11:
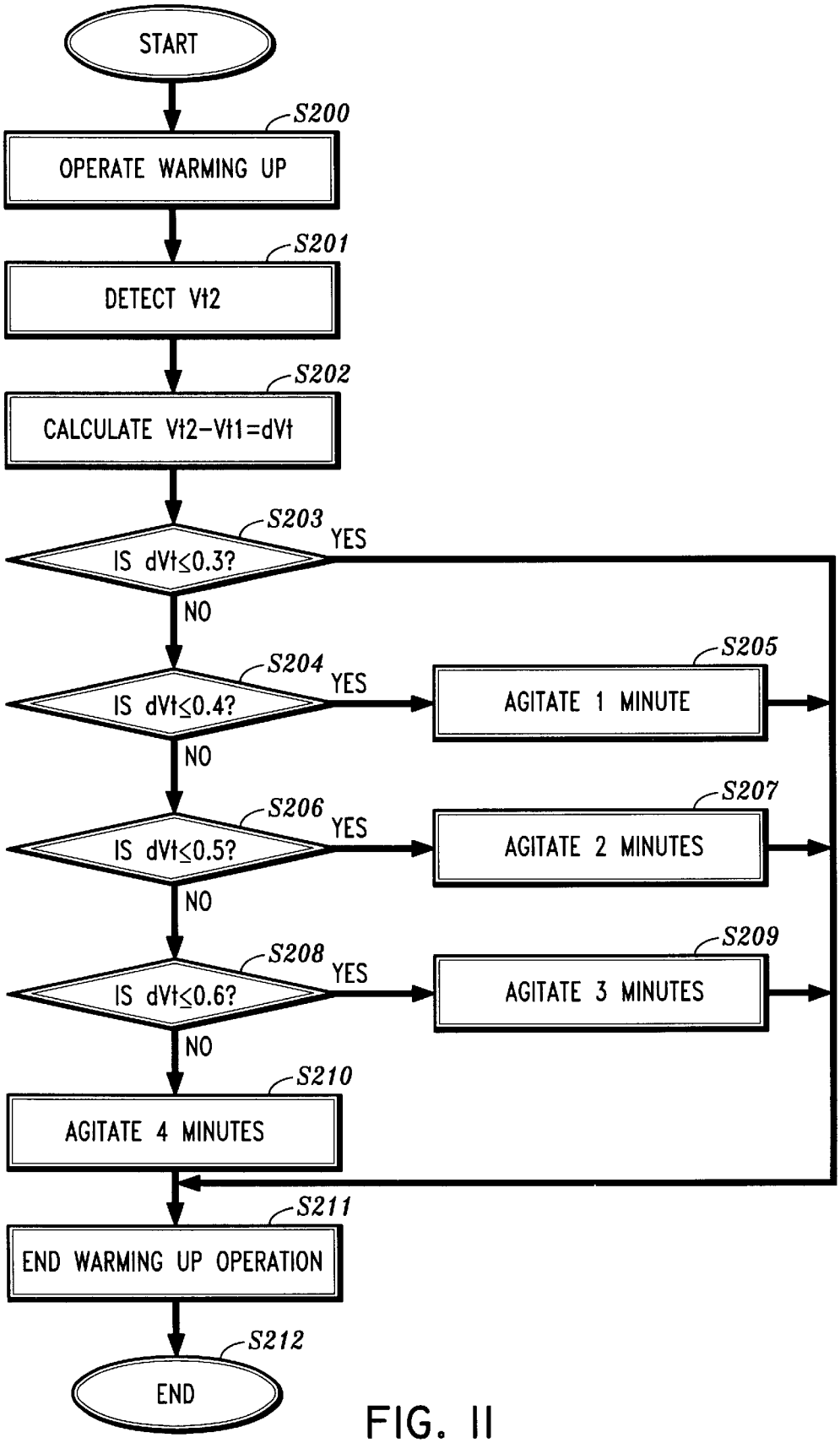
FIG. 11 is a flowchart showing another variation of the toner-density controlling of the copying machine illustrated in FIG. 8 when the image forming operation is performed.

FIG. 11 shows a part of a processing flow of the control circuit 25 in which the agitating time of the developer 91 is changed stepwise. This process is performed by the image forming apparatus control circuit 25 shown in FIG. 8. In this embodiment, a toner density of the developer 91 can properly be detected even when the image forming apparatus is left for an extremely long period of time without being used, and further, the developer 91 can rapidly be recovered, and therefore the proper toner density detection can be performed in a relatively short time.

A method for stepwise changing of the agitating time during the warm-up time of the developer 91 is as follows. Steps S200 through S202 in FIG. 11 are the same as steps S100 through S102 in FIG. 10 and accordingly, will not be explained again in detail. Steps S203 through S210 are the steps for stepwise changing of the agitating time of the developer 91. The agitating time period is changed as follows.

At first, if the control circuit 25 judges that dVt is 0.3 or less (dVt≦0.3) in step S203, the agitating operation of the developer 91 is not performed and the warming up operation ends in step S211.

If the control circuit judges that dVt is more than 0.3 and less than or equal to 0.4 (0.3<dVt≦0.4) in steps S203 and S204, the program proceeds to step S205 and the agitating operation of the developer 91 is performed for one minute and the warm-up operation then ends in step S211.

If the control circuit judges that dVt is greater than 0.4 and less than or equal to 0.5 (0.4<dVt≦0.5) in steps S204 and S206, the program proceeds to step S207 and the agitating operation of the developer 91 is performed for two minutes and the warm-up operation then ends in step S211.

If the control circuit judges that dVt is greater than 0.5 and less than or equal to 0.6 (0.5<dVt≦0.6) in steps S206 and S208, the program proceeds to step S209 and the agitating operation of the developer 91 is performed for three minutes and the warm-up operation then ends in step S211.

Furthermore, if the control circuit judges that dVt is greater than 0.6 (dVt>0.6) in step S208, the agitating operation of the developer 91 is performed for four minutes and the warm-up operation ends in step S211 and the procedure ends (step S212).

Thus, by stepwise changing the agitating time during the warm-up operation of the developer 91, namely, changing the agitating time according to the situation of the developer 91, the waiting time caused by the warm-up of the image forming apparatus is minimized and an image having good qualities without background fouling, toner dust, and toner scattering can be obtained.

Figure 12:
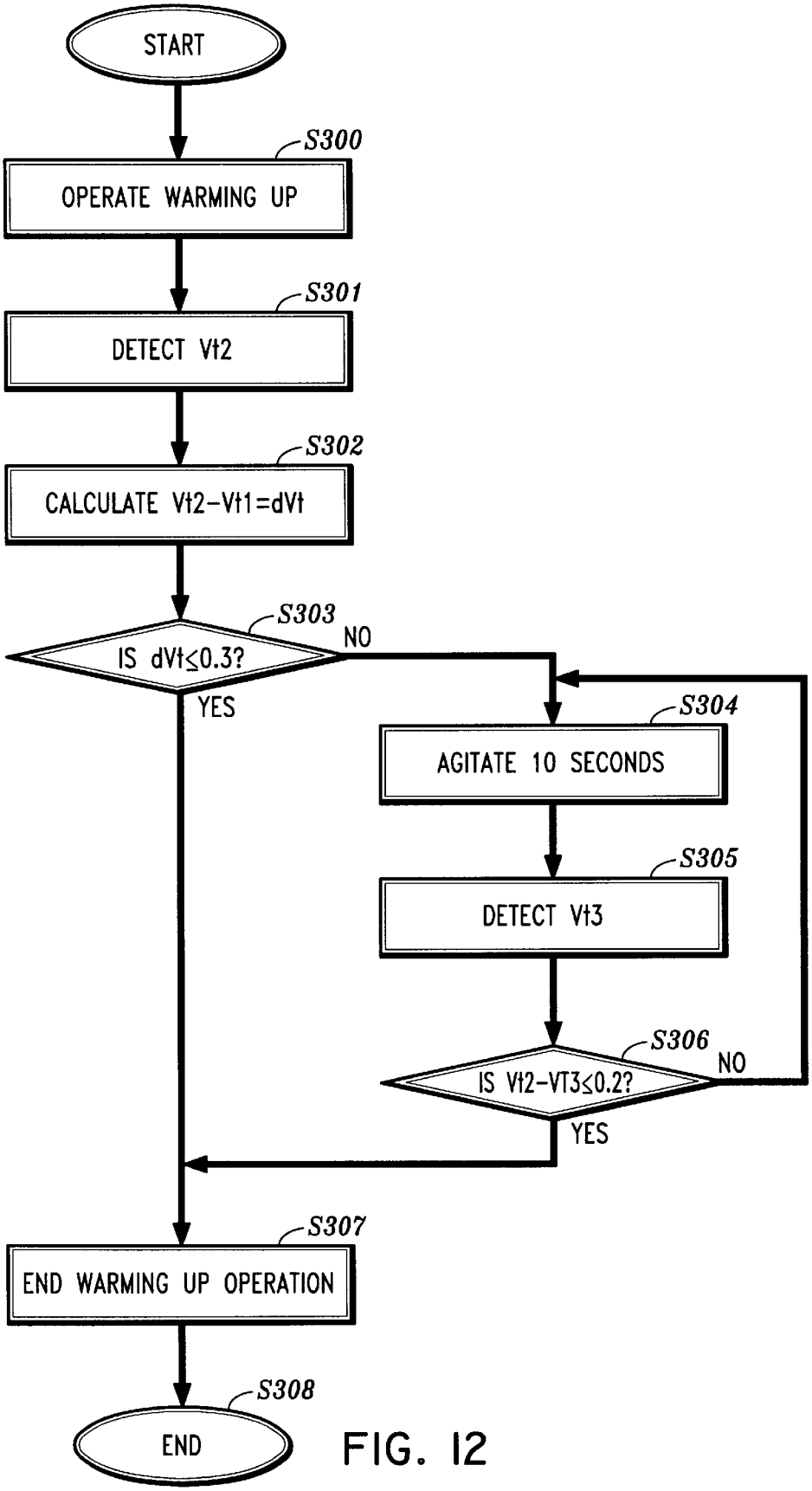
FIG. 12 is a flowchart showing still another variation of the toner-density controlling of the copying machine illustrated in FIG. 8 when the image forming operation is performed.

FIG. 12 shows a process performed by the control circuit in which the agitation of the developer 91 is performed until the output value Vt2 reaches a certain reference value on the basis of the result of the comparison of the output value Vt2, which is detected by the toner-density detecting sensor 46 during the warm-up of the image forming apparatus, and the output value Vt1 from the previous image forming operation. This process is performed by the image forming apparatus control circuit 25 shown in FIG. 8.

In this embodiment, the agitating operation is controlled to continue until the output value of the toner-density detecting sensor 46 during the warm-up time has approximately recovered to a certain reference value, for example, the output value of the toner-density detecting sensor in the previous image forming operation (0.2 in the embodiment described below).

That is, during the warming up time (step S300), the output value of the toner-density detecting sensor 46 is detected every three seconds (step S301), dVt is calculated by comparing the detected value Vt2 with the average value Vt1 of the toner-density detecting sensor 46 from the previous image forming operation (step S302).

The difference dVt is then compared with a predetermined reference value (0.3 in this case) in step S303, and if it is judged that dVt is greater than 0.3, the agitating operation of the developer 91 is performed for a predetermined time (10 seconds in this case) in step S304.

Next, after the agitation of the developer 91, the control circuit 25 performs the detection of the toner density (in step S305), and using the detected value (Vt3), the control circuit 25 performs the calculation of (Vt2−Vt3), and determines if the difference is less than or value is greater than 0.2, (step S306). If the value is greater than 0.2, the process returns to step S304 and the agitating operation of the developer 91 is repeated. This process repeats until the result of the comparison reaches 0.2 or less and the warming up operation then ends in step S307 and the procedure ends (step S308).

Thus, by repeating the agitation of the developer 91 until the toner density reaches the previous level, the charging amount can be recovered and a desirable image without toner dust, toner scattering, or the like can be obtained.

The controller of this invention may be conveniently implemented using a conventional general purpose digital computer or microprocessor programmed according to the teachings of the present specification, as is apparent to those skilled in the computer technology. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Numerous modifications and variations of the present invention are possible in light of the above teachings. It is therefore to be understood that within the scope of the appended claims, the invention may be practiced otherwise than as specifically described herein.

This application is based on Japanese Patent Application No. Japanese Patent Application No.08-292007, filed on Nov. 1, 1996, Japanese Patent Application No.08-314197, filed on Nov. 11, 1996 and Japanese Patent Application No.09-231795, filed on Aug. 12, 1997, the entire contents of which are herein incorporated by reference.

What is claimed is:

1. An image forming apparatus comprising:

an image bearing member;

a latent image forming device which performs an image forming operation for forming a latent image on said image bearing member;

a developing device which develops the latent image using a two-component developer including a toner and a carrier;

a toner supplying device which supplies the toner into said developing device;

a developer agitating device which agitates the two-component developer in said developing device;

a toner-density detecting device which detects a toner density of the developer in said developing device; and a toner-density control device which controls the toner density by operating said toner supplying device on the basis of a detected result of said toner-density detecting device;

a memory device which stores detected results of the toner density detected by said toner-density detecting device, wherein said toner-density detecting device detects the toner density during a warm-up operation before starting the image forming operation by said image forming apparatus, and said toner-density control device changes an amount of toner which is supplied by said toner supplying device after starting the image forming operation according to a result of a comparison of the detected toner density in the warm-up operation and the detected result stored in said memory device.

2. The image forming apparatus as claimed in claim 1, wherein said toner-density control device changes the amount of toner supplied by said toner supplying device until a predetermined time has passed after the start of the image forming operation according to the result of said comparison.

3. The image forming apparatus as claimed in claim 2, wherein said toner-density control device determines the predetermined time according to the result of said comparison.

4. The image forming apparatus as claimed in claim 1, wherein the toner density is detected during the warm-up operation, and the amount of toner supply is corrected from a first toner supply after a previous stop of said image forming apparatus according to the result of the comparison of the detected toner density during the warm-up operation and the detected result of the toner density stored in said memory device.

5. The image forming apparatus as claimed in claim 1, wherein the toner is supplied by said toner supplying device on the basis of the difference between the detected result of the toner density by said toner-density detecting device and a reference value of the toner density, and the reference value is changed according to the result of the comparison of the detected value of the toner density warm-up operation and the detected result stored in said memory device.

6. An image forming apparatus comprising:

an image bearing member;

a latent image forming device which forms a latent image on said image bearing member;

a developing device which develops the latent image using a two-component developer including a toner and a carrier;

a toner supplying device which supplies the toner into said developing device;

a developer agitating device which agitates the two-component developer in said developing device;

a toner-density detecting device which detects a toner density of the developer in said developing device;

a toner-density control device which controls the toner density by operating said toner supplying device based on the detected result by said toner-density detecting device, wherein an output value of said toner-density detecting device is detected during a warm-up operation of said image forming apparatus; and a comparator for comparing the output value of the toner density and an output value of said toner-density detecting device detected and stored during a previous image forming operation, wherein an agitating time of the developer is changed according to a result of the comparison by said comparator.

7. The image forming apparatus as claimed in claim 6, wherein the agitating time is changed stepwise.

8. An image forming apparatus comprising:

an image bearing member;

a latent image forming device which forms a latent image on said image bearing member;

a developing device which develops the latent image using a two-component developer including a toner and a carrier;

a toner supplying device which supplies the toner into said developing device;

a developer agitating device which agitates the two-component developer in said developing device;

a toner-density detecting device which detects a toner density of the developer in said developing device;

a toner-density control device which controls the toner density by operating said toner supplying device based on a detected result of said toner-density detecting device, wherein an output value of said toner-density detecting device is detected during a warm-up operation of said image forming apparatus; and a comparator for comparing the output value of the toner density and an output value of said toner-density detecting device detected and stored during a previous image forming operation, wherein agitating of the developer is performed until the output value reaches a certain reference value, according to the result of a comparison by said comparator.

9. An image forming apparatus comprising:

image bearing means;

means for performing an image forming operation for forming a latent image on said image bearing means;

means for developing the latent image using a two-component developer including a toner and a carrier;

means for supplying the toner into said developing means;

means for agitating the two-component developer in said developing means;

means for detecting a toner density of the developer in said developing means;

means for controlling the toner density by operating said toner supplying means based on the detected result by said toner density detecting means; and memory means for storing detected results of the toner density detected by said toner density detecting means, wherein said toner density detecting means detects the toner density during a warm-up operation before starting the image forming operation by said image forming apparatus, and said toner density controlling means changes an amount of toner which is supplied by said toner supplying means after starting the image forming operation according to a result of comparison of the toner density detected during the warm-up operation and the detected result stored in said memory means.

10. The image forming apparatus as claimed in claim 9, wherein said toner density controlling means changes the amount of toner supplied by said toner supplying means until a predetermined time has passed after start of the image forming operation according to the result of comparison.

11. The image forming apparatus as claimed in claim 10, wherein said toner density controlling means determines the predetermined time according to the result of the comparison.

12. The image forming apparatus as claimed in claim 9, wherein the toner density is detected during the warm-up operation, and the amount of the toner supply is corrected from a first toner supply after a previous stop of said image forming apparatus according to the result of the comparison of the detected toner density during the warm-up operation and the detected result of the toner density stored in said memory means.

13. The image forming apparatus as claimed in claim 9, wherein the toner is supplied by said toner supplying means based on the difference between the result of the toner density detected by said toner density detecting means and a reference value of the toner density, and the reference value is changed according to the result of the comparison of the detected value of the toner density detected during the warm-up operation and the detected result stored in said memory means.

14. An image forming apparatus comprising:

image bearing means;

means for forming a latent image on said image bearing means;

means for developing the latent image using a two-component developer including a toner and a carrier;

means for supplying the toner into said developing means;

means for agitating the two-component developer in said developing means;

means for detecting a toner density of the developer in said developing means;

means for controlling the toner density by operating said toner supplying means based on the detected result by said toner density detecting means, wherein an output value of said toner density detecting means is detected during a warm-up operation of said image forming apparatus; and means for comparing the output value of the toner density and an output value of said toner density detecting means detected and stored during a previous image forming operation, wherein an agitating time of the developer is changed according to a result of a comparison.

15. The image forming apparatus as claimed in claim 14, wherein the agitating time is changed stepwise.

16. An image forming apparatus comprising:

image bearing means;

means for forming a latent image on said image bearing means;

means for developing the latent image using a two-component developer including a toner and a carrier;

means for supplying the toner into said developing means;

means for agitating the two-component developer in said developing means;

means for detecting a toner density of the developer in said developing means;

means for controlling the toner density by operating said toner supplying means based on the detected result of said toner-density detecting means, wherein an output value of said toner-density detecting means is detected during a warm-up operation of said image forming apparatus; and means for comparing the output value of the toner density and an output value of said toner density detecting means detected and stored during a previous image forming operation, wherein agitating of the developer is performed until the output value reaches a certain reference value, according to a result of a comparison by said means for comparing.

17. An image forming method for controlling toner density comprising the steps of:

detecting a toner density of a developer in a developing device;

controlling the toner density by supplying toner to the developing device based on the detected result of said toner density detecting step; and storing the detected result of said toner density detecting step in a memory;

detecting the toner density during a warm-up operation before starting an image forming operation by an image forming apparatus;

comparing the toner density detected during the warm-up operation and a detected result stored in the memory; and changing an amount of toner which is supplied to the developing device after starting the image forming operation according to a result of the comparison step.

18. The image forming method as claimed in claim 17, wherein the amount of the toner supplied to the developing device is changed until a predetermined time is passed after the start of the image forming operation according to the result of said comparison step.

19. The image forming method as claimed in claim 18, wherein said predetermined time is determined according to the result of the comparison step.

20. The image forming method as claimed in claim 17, wherein the toner density is detected during the warm-up operation, and the amount of the toner supply is corrected from a first toner supply after a previous stop of the image forming apparatus according to the result of the comparison step.

21. The image forming method as claimed in claim 17, further comprising steps of:

supplying the toner based on a difference between the detected result of the toner density and a reference value of the toner density; and changing the reference value according to the result of the comparison step.

22. An image forming method for controlling toner density comprising the steps of:

detecting a toner density of a developer in a developing device;

controlling the toner density by supplying toner to the developing device based on the detected result of said toner density detecting step;

storing the detected result of said toner density detecting step in a memory device;

comparing the output value of the toner density and the stored density value; and detecting the toner density during a warm-up operation of an image forming apparatus; and controlling a time in which the developer is agitated according to the result of a comparison.

23. The image forming method as claimed in claim 22, wherein the agitating time is changed stepwise.

24. An image forming method for controlling toner density comprising the steps of:

detecting a toner density of a developer in a developing device;

controlling the toner density by supplying toner to the developing device based on the detected result of said toner density detecting step; and storing the detected result of said toner density detecting step in a memory device;

comparing the output value of the toner density and an output value of the toner density detected and stored during a previous image forming operation; and detecting an output value of said toner density during a warm-up operation of an image forming apparatus; and controlling an agitating time of the developer until the output value reaches a certain reference value, according to the result of the comparison.

* * * * *